US011304530B1

(12) United States Patent
Lin

(10) Patent No.: US 11,304,530 B1
(45) Date of Patent: Apr. 19, 2022

(54) AUXILIARY CHAIR

(71) Applicant: Forever Young Enterprise Co., Ltd., New Taipei (TW)

(72) Inventor: Fang-Sheng Lin, Tainan (TW)

(73) Assignee: Forever Young Enterprise Co., Ltd., New Taipei (TW)

( * ) Notice: Subject to any disclaimer, the term of this patent is extended or adjusted under 35 U.S.C. 154(b) by 0 days.

(21) Appl. No.: 17/314,237

(22) Filed: May 7, 2021

(51) Int. Cl.
*A47C 3/34* (2006.01)
*A47K 11/04* (2006.01)

(52) U.S. Cl.
CPC ..... *A47C 3/34* (2013.01); *A47K 11/04* (2013.01)

(58) Field of Classification Search
CPC ..... A47K 3/122; A47K 3/282; A61H 2201/0149; A61G 7/1003; A47D 1/004; A47C 3/34
USPC ..... 297/440.22, 440.23, 440.24
See application file for complete search history.

(56) References Cited

U.S. PATENT DOCUMENTS 5,984,418 A * 11/1999 McInturff ..... A61G 5/1062 248/298.1
6,122,776 A * 9/2000 Cheng ..... A47K 3/122 297/440.24
7,121,620 B1 * 10/2006 Fang ..... A47C 3/34 297/51
2017/0172353 A1 * 6/2017 Chao ..... F16B 12/26

* cited by examiner

*Primary Examiner* — Sarah B McPartlin
(74) *Attorney, Agent, or Firm* — Karin L. Williams; Alan D. Kamrath; Mayer & Williams PC

(57) ABSTRACT

An auxiliary chair includes a supporting unit and a seating unit. The supporting unit includes a plurality of chair legs. The seating unit includes a seat cushion and a cushion frame installed on a bottom surface of the seat cushion. The cushion frame includes two spaced support tubes and two spaced connecting plates. The first and second ends of each support tube are respectively connected to one of the chair legs through a cushion connection tube, so that the seating unit is supported by the chair legs of the supporting unit. A lug extends from each of the first and second ends of each support tube. The connecting plates straddle the first end and the second end of the support tubes respectively. The connecting plates are combined with the lugs of the support tubes by connecting members, so that the support tubes and the connecting plates are detachably combined.

6 Claims, 7 Drawing Sheets

AUXILIARY CHAIR

BACKGROUND OF THE INVENTION

1. Field of the Invention

The present invention relates to an auxiliary chair and, more particularly, to a combination structure of a cushion frame of an auxiliary chair.

2. Description of the Related Art

Persons with disabled lower limbs or impaired mobility cannot live independently. They often rely on carers and assistant devices in daily living activities, such as getting up, rehabilitating, or bathing. Combined auxiliary chairs such as bedpan chairs or bath chairs that can be seen in the general market are the most common nursing aids in daily life. The basic structure of the conventional auxiliary chair includes a supporting unit and a seating unit. The supporting unit includes a plurality of chair legs. The seating unit includes a seat cushion, a cushion frame mounted on a bottom surface of the seat cushion, and a plurality of cushion connection tubes which connect the cushion frame and the plurality of chair legs. The cushion frame generally includes spaced front and rear support tubes, and one end of each cushion connection tube is movably combined in one of the front and rear support tubes, so that the width of the auxiliary chair is adjustable. Furthermore, in order for the cushion frame to have sufficient support strength, the cushion frame generally further includes two spaced side tubes, which are fixed between the front support tube and the rear support tube by welding, so that the cushion frame forms a frame body. However, the distance between the front support tube and the rear support tube cannot be adjusted due to the fact that the frame body cannot be detached, so that the cushion frame is only suitable for installation on a seat cushion of a corresponding size. In addition, the electroplating implementation price of the auxiliary chair components depends on the area size, and such a conventional cushion frame that cannot be detached has a large area, resulting in an increase in the cost of implementing the electroplating.

BRIEF SUMMARY OF THE INVENTION

Thus, an objective of the present invention is to provide an auxiliary chair. The cushion frame of the auxiliary chair is provided with sufficient supporting strength, and components of the cushion frame are designed to be detachably combined, so that the longitudinal distance of the cushion frame is adjustable so as to be applicable to the seat cushion of different sizes, and the cushion frame can effectively reduce the cost of implementing electroplating.

To achieve this and other objectives, an auxiliary chair of the present invention generally includes a supporting unit and a seating unit. The supporting unit includes a plurality of chair legs. The seating unit is supported by the chair legs of the supporting unit and includes a seat cushion and a cushion frame mounted on a bottom surface of the seat cushion. The cushion frame includes two support tubes spaced in a longitudinal direction and two connecting plates spaced in a transverse direction perpendicular to the longitudinal direction. Each of the support tubes includes first and second ends spaced in the transverse direction. The first and second ends of each support tube respectively extend with a lug that abuts against the bottom surface of the seat cushion. The connecting plates respectively span the support tubes and are positioned below the lugs of the support tubes. The connecting plates are combined with the lugs of the support tubes by connecting members, so that the connecting plates are detachably combined with the support tubes.

In a preferred form, the supporting unit further includes a cushion sleeve fixed to an upper end of each chair leg, and the seating unit further includes a plurality of cushion connection tubes. Each cushion connection tube includes a transverse section and a vertical section. The vertical section of each cushion connection tube is engaged in a corresponding cushion sleeve, and the transverse section of each cushion connection tube is engaged in the first end or the second end of one of the support tubes.

In a preferred form, each support tube has a tube hole therein, and the first and second ends of each support tube are respectively provided with a plurality of adjustment holes in communication with the tube hole. A button is provided on the transverse section of each cushion connection tube and engaged in one of the adjustment holes in a corresponding support tube.

In a preferred form, a support sleeve is installed between each lug of the support tubes and a corresponding connecting plate.

In a preferred form, a seat back is installed on a rear side of the seat cushion and has two seat back supporting tubes, and the connecting plates are respectively provided with a seat back connecting tube to be engaged with one of the two seat back supporting tubes.

In a preferred form, the supporting unit further includes two armrests, and the cushion sleeve is connected with an armrest sleeve which is fixed to the upper end of one of the chair legs to be combined with a corresponding armrest.

The present invention will become clearer in light of the following detailed description of illustrative embodiments of this invention described in connection with the drawings.

DESCRIPTION OF THE DRAWINGS

The illustrative embodiments may best be described by reference to the accompanying drawings where.

DETAILED DESCRIPTION OF THE INVENTION

Figure 1:
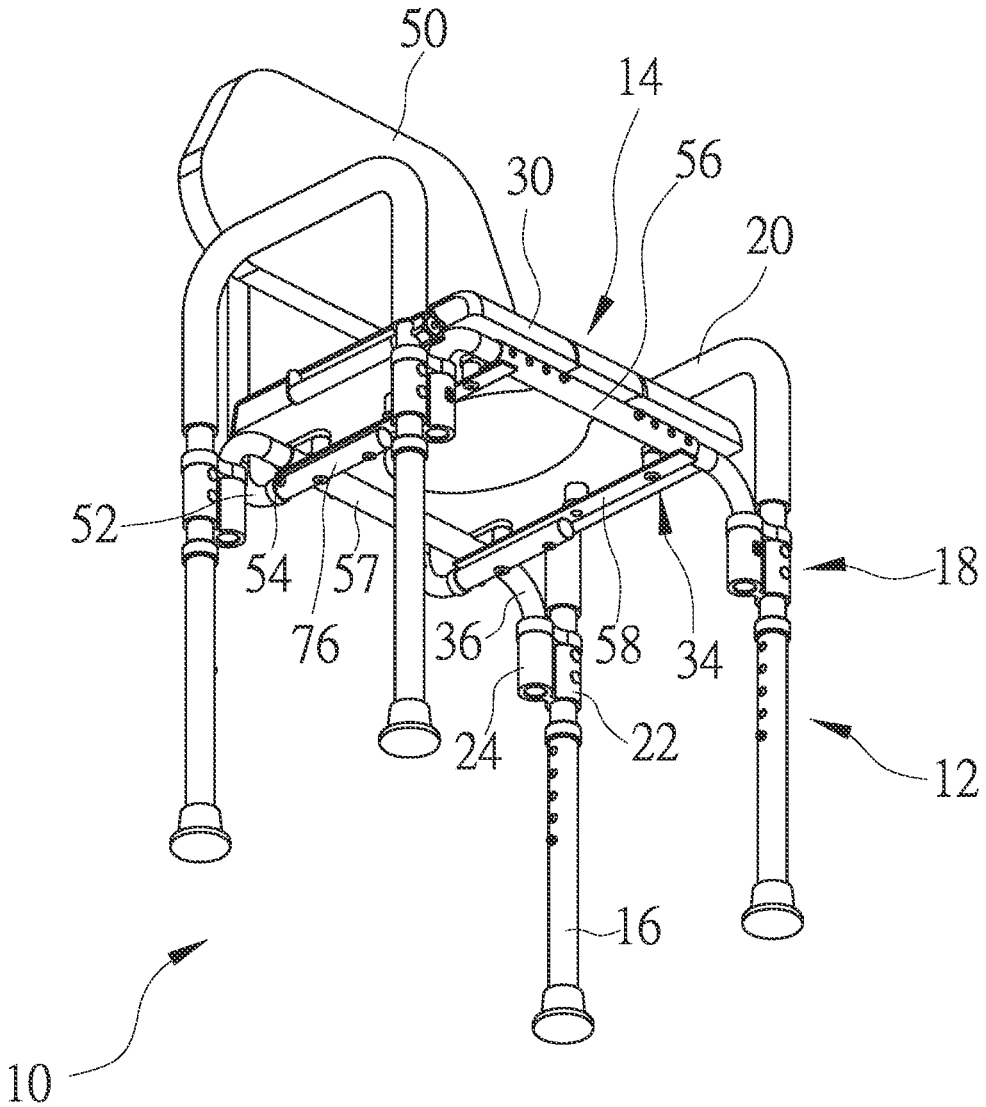
FIG. 1 is a perspective view of an auxiliary chair in accordance with an embodiment of the present invention.
Figure 2:
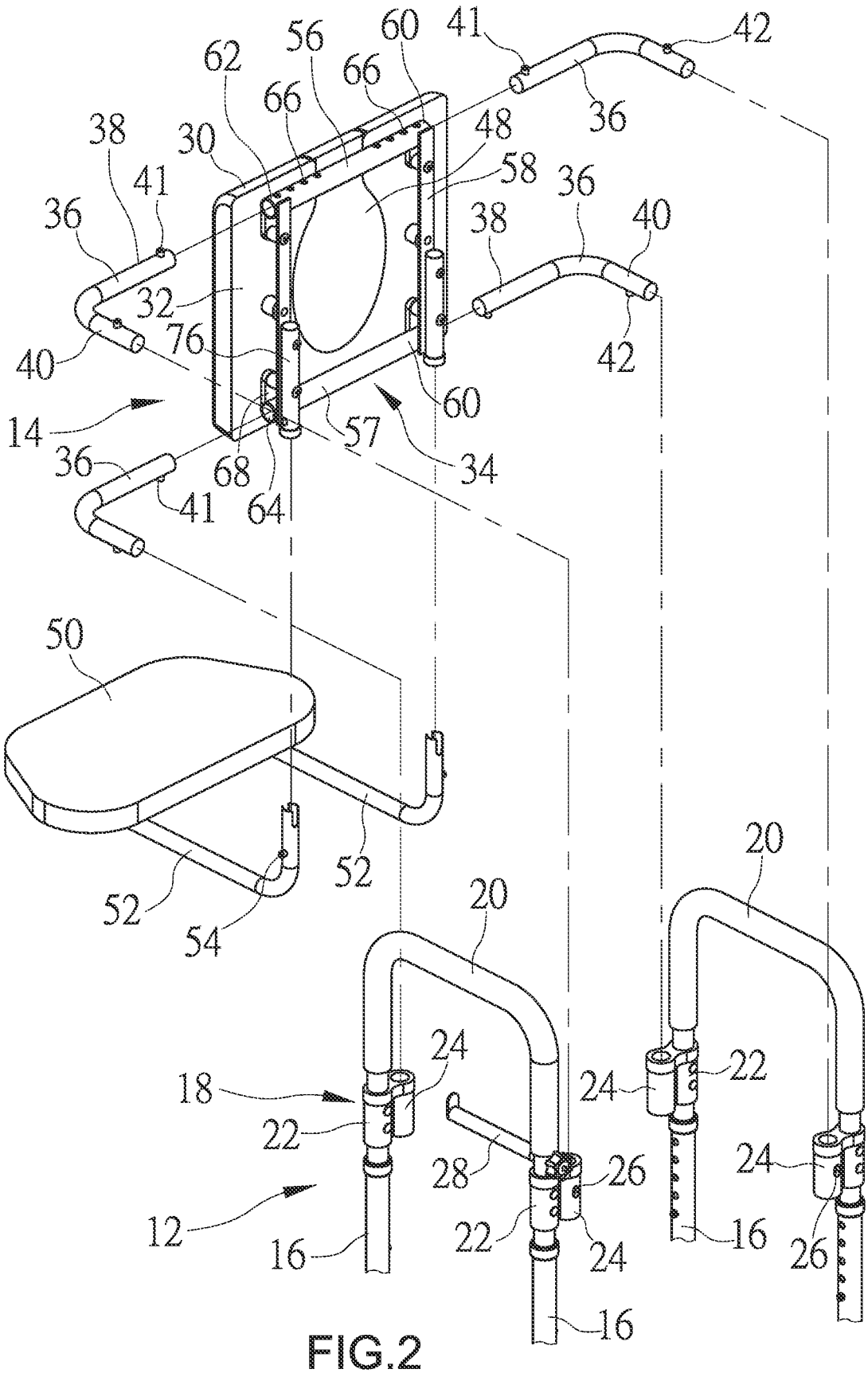
FIG. 2 shows an exploded view of the auxiliary chair of FIG. 1.
Figure 3:
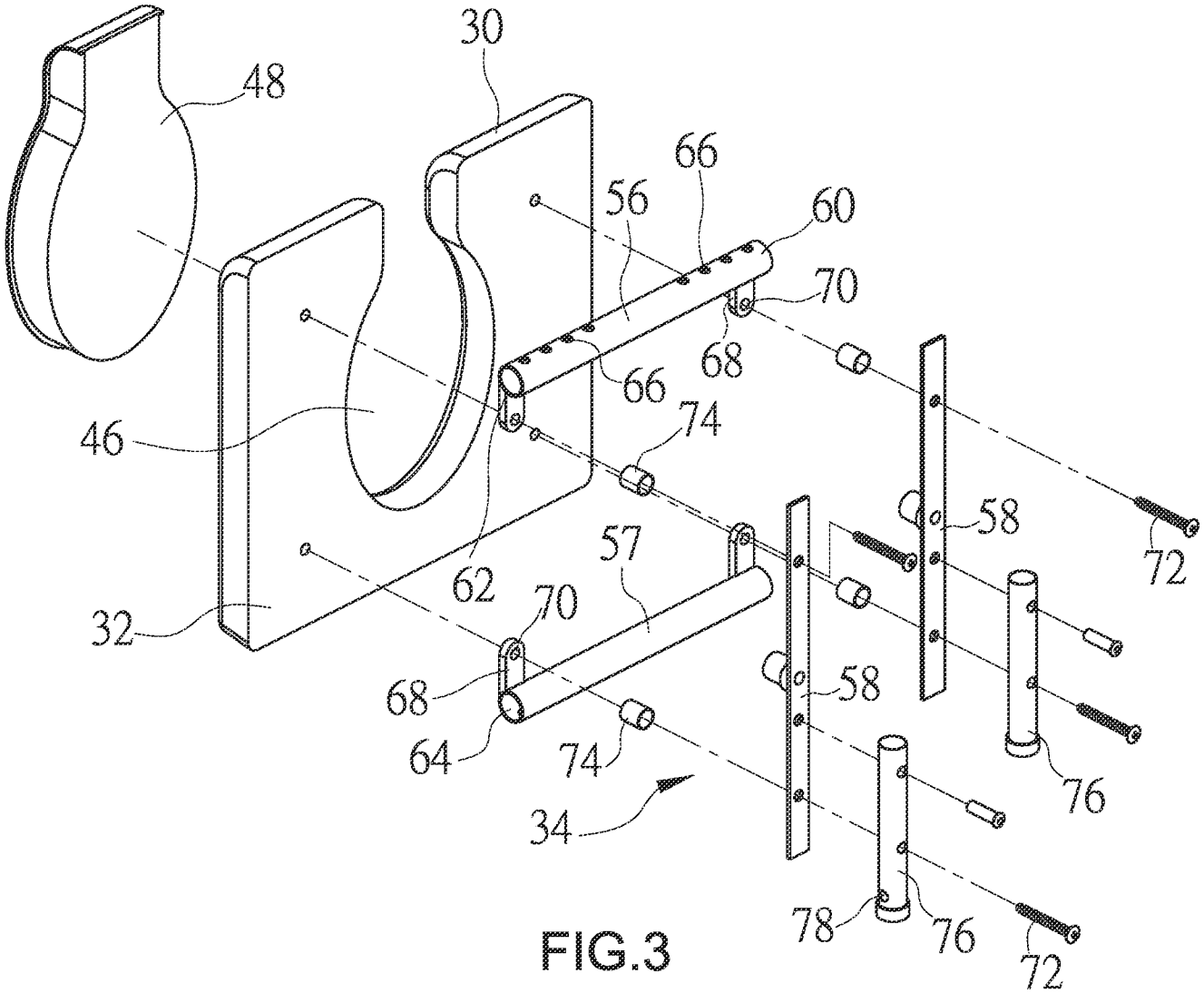
FIG. 3 shows an exploded view of a seat cushion and a cushion frame of the auxiliary chair of FIG. 1.
Figure 4:
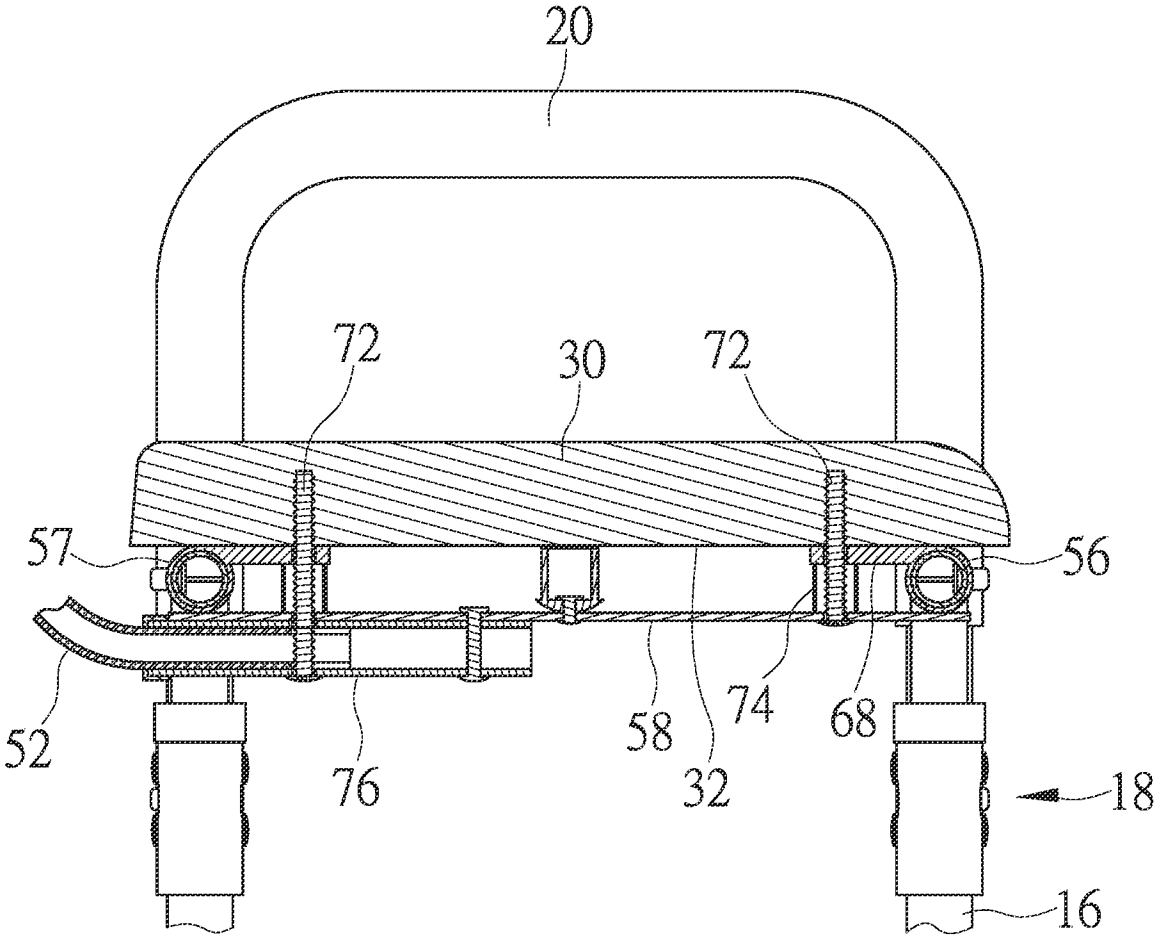
FIG. 4 shows a sectional view of the auxiliary chair of FIG. 1.
Figure 5:
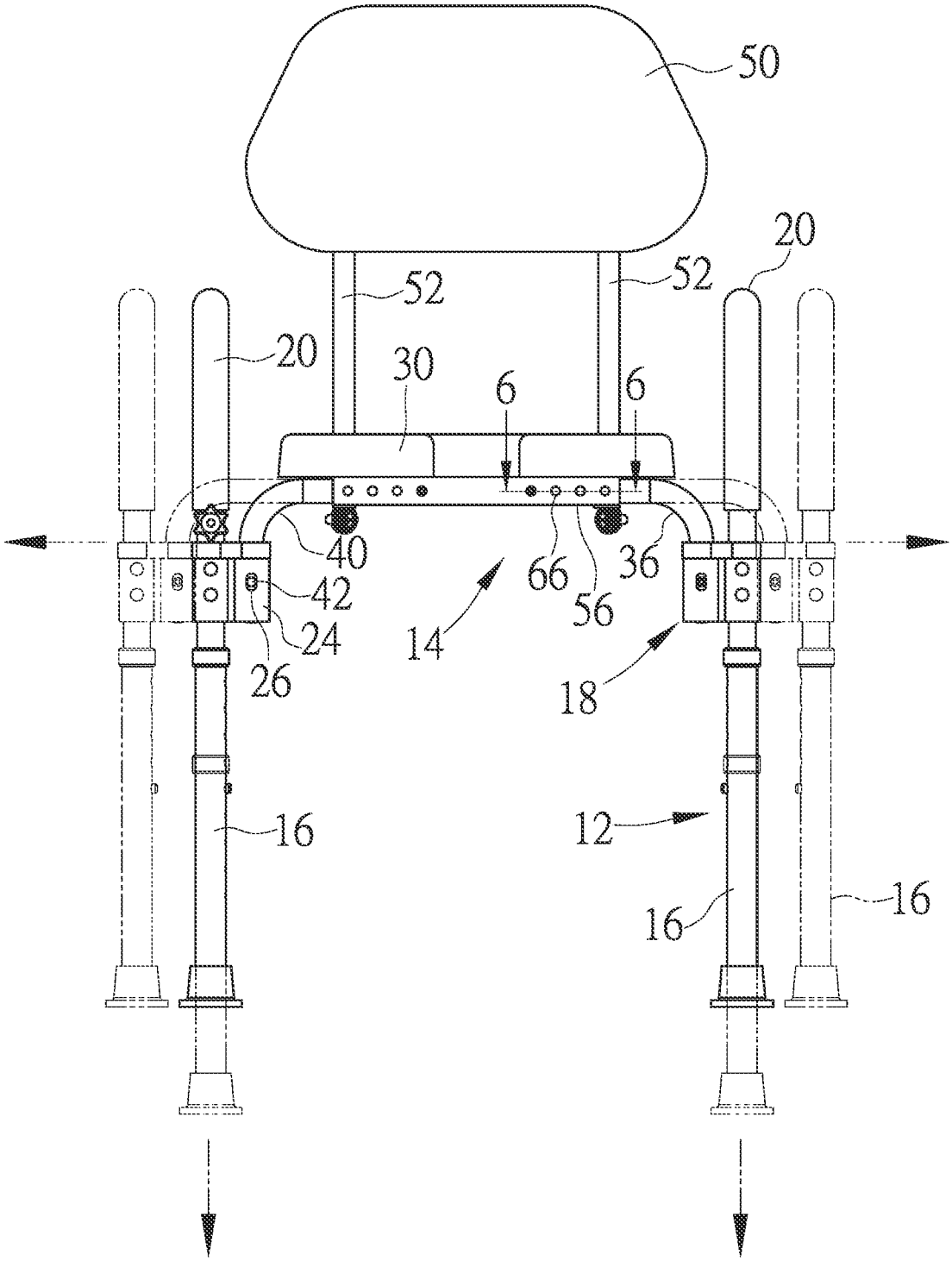
FIG. 5 shows a schematic view which illustrates a supporting unit of the auxiliary chair of FIG. 1 capable of being adjusted in width.

An auxiliary chair according to the preferred teachings of the present invention is shown in FIGS. 1 through 6 of the drawings and generally designated 10. In this embodiment, the auxiliary chair 10 is a bedpan chair, which is suitable for a user to sit on. The auxiliary chair 10 includes a supporting unit 12 and a seating unit 14. The supporting unit 12 includes a plurality of chair legs 16, a connecting unit 18 fixed to an upper end of each chair leg 16, and two armrests 20. The chair leg 16 is a rod body that can be adjusted in length (FIG. 5). Each connecting unit 18 has an armrest sleeve 22 and a cushion sleeve 24 adjacent to each other. A lower section of the armrest sleeve 22 is correspondingly fixed to the upper end of one of the chair legs 16. At least one hole 26 is provided in an appropriate place on an outer wall of the cushion sleeve 24. The armrest 20 is a generally U-shaped tube, and the ends of its two vertical portions are respectively fixed to upper sections of two opposite armrest sleeves 22. The supporting unit 12 may further include a hanging member 28 for hanging toilet paper or wet tissues. Since the structure of the supporting unit 12 is not the technical focus of this present invention, it will not be repeated here.

Figure 6:
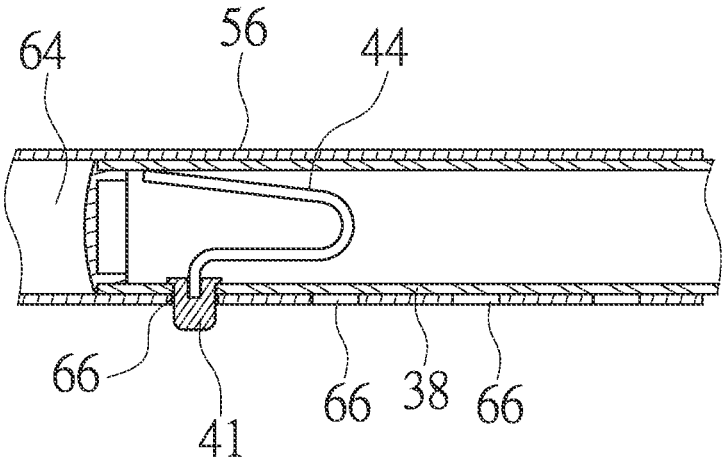
FIG. 6 is a cross-sectional view taken along line 6-6 of FIG. 5.

The seating unit 14 is supported by the chair legs 16 of the supporting unit 12 and includes a seat cushion 30, a cushion frame 34 installed on a bottom surface 32 of the seat cushion 30, and a plurality of cushion connection tubes 36. In this embodiment, the seating unit 14 includes four cushion connection tubes 36. Each cushion connection tube 36 is L-shaped and includes a transverse section 38 and a vertical section 40. Buttons 41 and 42 are respectively provided on the transverse section 38 and the vertical section 40, and each button 41, 42 is connected with an elastic member 44 accommodated in each cushion connection tube 36 (FIG. 6). When the buttons 41, 42 are pressed, the buttons can be retracted into the cushion connection tube 36 by the elasticity of the elastic member 44. The construction of the buttons 41, 42 and the elastic member 44 is a conventional technology, and will not be repeated here.

The vertical section 40 of each cushion connection tube 36 is engaged in a corresponding cushion sleeve 24 with the button 42 received in the hole 26 in the corresponding cushion sleeve 24 (see FIG. 5). In this embodiment, the seat cushion 30 is provided with an opening 46, and a cover plate 48 is installed in the opening 46 to detachably close the opening 46. After the cover plate 48 is taken down, a container such as a bedpan can be placed under the opening 46 to allow a person with reduced mobility for toilet use. In this embodiment, a seat back 50 is installed on a rear side of the seat cushion 30 and has two generally L-shaped seat back supporting tubes 52. The horizontal end of each seat back supporting tube 52 is provided with a button 54 connected to an elastic member (not shown) accommodated in the seat back supporting tube 52.

The technical feature of the present invention is the structural design of the cushion frame 34. The cushion frame 34 includes two support tubes 56 and 57 spaced in a longitudinal direction and two connecting rods or connecting plates 58 spaced in a transverse direction perpendicular to the longitudinal direction and detachably connected to the two support tubes 56, 57. In this embodiment, the support tubes 56, 57 are respectively disposed on front and rear sides of the bottom surface 32 of the seat cushion 30 and include first and second ends 60 and 62 spaced in the transverse direction. Each support tube 56, 57 has a tube hole 64 therein, and the first and second ends 60 and 62 of each support tube 56, 57 are respectively provided with a plurality of adjustment holes 66 in communication with the tube hole 64. The transverse sections 38 of the cushion connection tubes 36 are respectively engaged in the first and second ends 60 and 62 of the support tubes 56, 57 with the button 41 received in one of the adjustment holes 66 in the support tubes 56, 57 (see FIG. 6). Furthermore, the first end 60 and the second end 62 of each support tube 56, 57 respectively extend with a lug 68 that can abut against the bottom surface 32 of the seat cushion 30, and each lug 68 is provided with a through-hole 70. A connecting member 72, such as a screw, can pass through the through-hole 70 to fix the support tubes 56 and 57 on the bottom surface 32 of the seat cushion 30 with the lugs 68 abutting against the bottom surface 32 of the seat cushion 30. The connecting plates 58 respectively span the first end 60 and the second end 62 of the support tubes 56, 57 and are positioned below the lugs 68 and the support tubes 56, 57. Each connecting member 72 passes through each lug 68 and a corresponding connecting plate 58, so that the connecting plates 58 are detachably combined with the support tubes 56, 57. In this embodiment, a support sleeve 74 is installed between each lug 68 and a corresponding connecting plate 58, so that after the connecting plates 58 and the support tubes 56, 57 are combined, the support tubes 56, 57 can be fixed on the seat cushion 30 without skewing, thereby ensuring the alignment of the button 41 with each of the adjustment holes 66 in the support tubes 56, 57. In this embodiment, each connecting plates 58 is provided with a seat back connecting tube 76 for receiving the horizontal end of one of the seat back supporting tubes 52 of the seat back 50, and each seat back connecting tube 76 is provided with a coupling hole 78 for connecting with the button 54 of the seat back supporting tube 52.

According to the present invention, when the button 41 of each cushion connection tube 36 is pressed, the button 41 can be retracted by the elasticity of the elastic member 44, so that the transverse section 38 of the cushion connection tube 36 can move in one of the support tubes 56, 57 of the cushion frame 34. When the button 41 of the cushion connection tube 36 moves to another corresponding adjustment hole 66, the button 41 will protrude again to be engaged in the corresponding adjustment hole 66. By moving the cushion connection tube 36 relative to the cushion frame 34, the width of the seating unit 14 can be adjusted, thereby adjusting the width of the auxiliary chair 10. The adjustment method can be carried out unilaterally or bilaterally. It should be noted that in an embodiment, the cushion connection tube 36 may be provided with a plurality of adjustment holes, and the support tubes 56, 57 can be provided with a button, which can also achieve the telescopic and positioning functions.

The seating unit 14 of the present invention has the following advantages in addition to the function of adjusting the width of the auxiliary chair 10:

1. The support tubes 56, 57 and the connecting plates 58 of the cushion frame 34 are detachable components, and the area of individual components is small, which can effectively reduce the price of the electroplating implementation of the cushion frame 34.

2. By designing the lugs 68 on the support tubes 56 and 57 of the cushion frame 34 for allowing the connecting plates 58 to be detachably assembled on the support tubes 56, 57, the longitudinal distance between the support tubes 56 and 57 can be adjusted so that the cushion frame 34 is suitable for seat cushions 30 of different sizes. In addition, the connecting plates 58 in combination with the support tubes 56, 57 can provide sufficient support strength. Furthermore, the connecting members 72 do not extend through the support tubes 56, 57, and thus, does not affect the movement of the transverse section 38 of the cushion connection tube 36 in the support tubes 56, 57.

3. The support sleeve 74 is provided between each lug 68 and the corresponding connecting plate 58, so that after the support tubes 56, 57 are bonded to the bottom surface 32 of the seat cushion 30, the adjustment holes 66 provided in the support tubes 56, 57 do not deflect, thereby facilitating the alignment of the button 41 and any adjustment hole 66.

Figure 7:
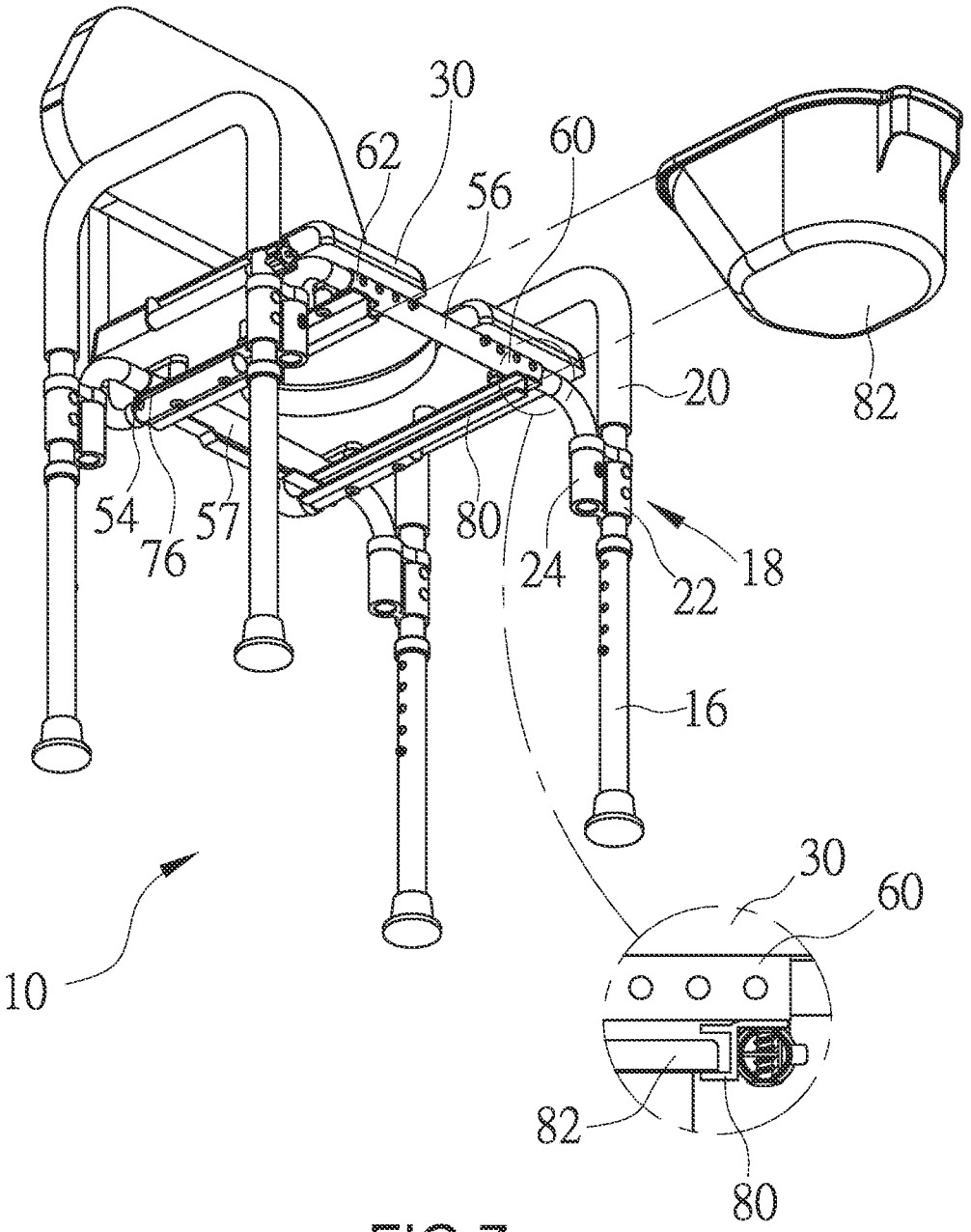
FIG. 7 is a schematic view of an auxiliary chair in accordance with another embodiment of the present invention.

Referring to FIG. 7, two spaced slide rails 80 and a bedpan 82 can be further provided under the seat cushion 30 of the seating unit 14 of the present invention. The slide rails 80 respectively span and are combined on the first end 60 and the second end 62 of the support tubes 56, 57, and the bedpan 82 is detachably installed on the slide rails 80 to accept the feces and urine from the occupants.

The scope of the invention is to be indicated by the appended claims, rather than by the foregoing description, and all changes which come within the meaning and range of equivalency of the claims are intended to be embraced therein.

The invention claimed is:

1. An auxiliary chair comprising:

a supporting unit including a plurality of chair legs; and a seating unit supported by the plurality of chair legs of the supporting unit and including a seat cushion and a cushion frame mounted on a bottom surface of the seat cushion, with the cushion frame including two support tubes spaced in a longitudinal direction and two connecting plates spaced in a transverse direction perpendicular to the longitudinal direction, with each of the two support tubes including first and second ends spaced in the transverse direction, wherein the first and second ends of each support tube respectively extend with a lug that abuts against the bottom surface of the seat cushion, the two connecting plates respectively span the two support tubes and are positioned below the lugs of the two support tubes, and the two connecting plates are combined with the lugs of the two support tubes by connecting members, so that the two connecting plates are detachably combined with the two support tubes.

2. The auxiliary chair of claim 1, wherein the supporting unit further includes a cushion sleeve fixed to an upper end of each chair leg, and the seating unit further includes a plurality of cushion connection tubes, with each cushion connection tube including a transverse section and a vertical section, with the vertical section of each cushion connection tube engaged in a corresponding cushion sleeve, with the transverse section of each cushion connection tube engaged in one of the first and second ends of a corresponding support tube.

3. The auxiliary chair of claim 2, wherein each support tube has a tube hole therein, and the first and second ends of each support tube are respectively provided with a plurality of adjustment holes in communication with the tube hole, with a button provided on the transverse section of each cushion connection tube and engaged in one of the plurality of adjustment holes in the corresponding support tube.

4. The auxiliary chair of claim 1, wherein a support sleeve is installed between each lug of the two support tubes and a corresponding connecting plate.

5. The auxiliary chair of claim 1, wherein a seat back is installed on a rear side of the seat cushion and has two seat back supporting tubes, and the two connecting plates are respectively provided with a seat back connecting tube to be engaged with one of the two seat back supporting tubes.

6. The auxiliary chair of claim 2, wherein the supporting unit further includes two armrests, and the cushion sleeve is connected with an armrest sleeve which is fixed to the upper end of one of the chair legs to be combined with a corresponding armrest.

* * * * *